United States Patent [19]

Garufi

[11] 3,980,092

[45] Sept. 14, 1976

[54] HAIRPIECE APPARATUS

[76] Inventor: Tino Garufi, 607 Wildwood Road West, North Vale, N.J. 07647

[22] Filed: Aug. 15, 1974

[21] Appl. No.: 497,519

[52] U.S. Cl. ..... 132/53
[51] Int. Cl.[2] ..... A41G 3/00
[58] Field of Search ..... 132/53, 54, 9

[56] References Cited

UNITED STATES PATENTS

| | | | |
|---|---|---|---|
| 1,490,479 | 4/1924 | Noel | 132/53 |
| 3,385,305 | 5/1968 | Buzzelli | 132/105 |
| 3,495,603 | 2/1970 | Young, Jr. | 132/53 |

*Primary Examiner*—G.E. McNeill
*Attorney, Agent, or Firm*—Sommers & Sommers

[57] ABSTRACT

A hairpiece apparatus which comprises a pad which may be positioned in and secured to the wearer's hair, and another pad which includes mounted thereon hair or hair-like fibers which may be formed into a hairstyle. Binding agents which substantially cover the interfaces of the pads enable secure interconnection and convenient separation of the pads with minimum disruption of the hairstyle resulting therefrom. The pad which may be positioned in and secured to the wearer's hair further includes a plurality of depending members which receive a small number of pad-securing means inserted therein to securely position the pad in the wearer's hair in a comfortable and convenient manner. The pad which includes hair or hair-like fibers mounted thereon further includes an extending portion which enables convenient separation of the pads.

1 Claim, 3 Drawing Figures

HAIRPIECE APPARATUS

BACKGROUND OF THE INVENTION

This invention relates generally to hairpieces, and more particularly relates to a hairpiece apparatus which is adapted to be positioned in the wearer's hair in a comfortable and secure manner.

A hairpiece pad heretofore employed included hair or hair-like fibers mounted thereon for forming a hairstyle therewith, which pad could be positioned in and secured directly to the wearer's hair. A large number of hairpins were required to secure the pad in the wearer's hair, which were uncomfortable and inconvenient to work with. Furthermore, locating and removing such hairpins in order to enable the pad to be removed from the wearer's hair was a difficult procedure which frequently resulted in disruption of the hairstyle. In forming a hairstyle from the hair or hair-like fibers mounted on the pad, the hairdresser used a large number of pins inserted through the pad and into a head form in order to secure the pad thereto, which pins were inconvenient to work with. A hairpiece apparatus heretofore employed included a pair of pads with small portions of the interface surfaces thereof covered with adhesive material. The small adhesive segments provided generally insecure interconnection of the pads, subjecting the pads to shifting with resultant disruption of the hairstyle. A large number of hairpins were required in order to position the pad in the wearer's hair, which hairpins were uncomfortable to the wearer, difficult to locate and remove, and covered substantial portions of the adhesive material on the interface of the pad which interfered with interconnection of the pads.

SUMMARY OF THE INVENTION

In accordance with the foregoing, it may be regarded as an object of the present invention to provide a hairpiece apparatus which enables a pad, to which another pad is attachable, to be comfortably positioned in and secured to the wearer's hair, and which enables the other pad which includes hair or hair-like fibers mounted thereon to be conveniently and securely interconnected to the first pad so as to prevent disruption of the hairstyle formed thereon. It is a further object of the present invention to prevent interference with interconnection of the pads by the means used to secure the pad in the wearer's hair. It is a still further object of the present invention to enable the user of a head form to secure the hairpiece thereto in a convenient and efficient manner. It is a still further object of the present invention to enable adapting a previously-owned hairpiece pad which includes hair or hair-like fibers mounted thereon to a pad which may be positioned in and secured to the wearer's hair.

In accordance with the present invention, the foregoing objects and others are achieved through provision of a hairpiece apparatus which includes a pad which may be positioned in and secured to the wearer's hair, another pad which includes hair or hair-like fibers mounted thereon, and binding agents which cover the interface surfaces of the pads, which enable the pads to be securely interconnected while enabling convenient separation thereof without disrupting the hairstyle. The pad which may be positioned in and secured to the wearer's hair further includes a plurality of depending members which receive a small number of pad-securing means inserted therein, which pad-securing means, upon positioning thereof in the depending members, are conveniently utilized and easily located without causing disruption of the hairstyle, which prevents interference by the pad-securing means with the binding agent, and which depending members enable the pad to be secured in the hair before attaching thereto the other pad with the hairstyle formed thereon, in order to further prevent disruption of the hairstyle. The pad which includes hair or hair-like fibers mounted thereon further includes an extending portion which enables convenient separation of such pad from the other pad. The user of a head form which includes a covering or binding agent thereon may connect thereto a pad with hair or hair-like fibers mounted thereon which includes a covering of binding agent on the interface surface thereof without the use of pins or the like. The interface surface of a previously-owned hairpiece pad which includes hair or hair-like fibers mounted thereon may be covered with binding agent for use in conjunction with a pad which includes a plurality of members which depend from one surface thereof and a binding agent covering another surface thereof to enable the hairpiece to be secured in the wearer's hair.

DESCRIPTION OF THE DRAWINGS

The invention is diagrammatically illustrated by way of example in the appended drawing wherein.

DESCRIPTION OF THE PREFERRED EMBODIMENT

Figure 1:
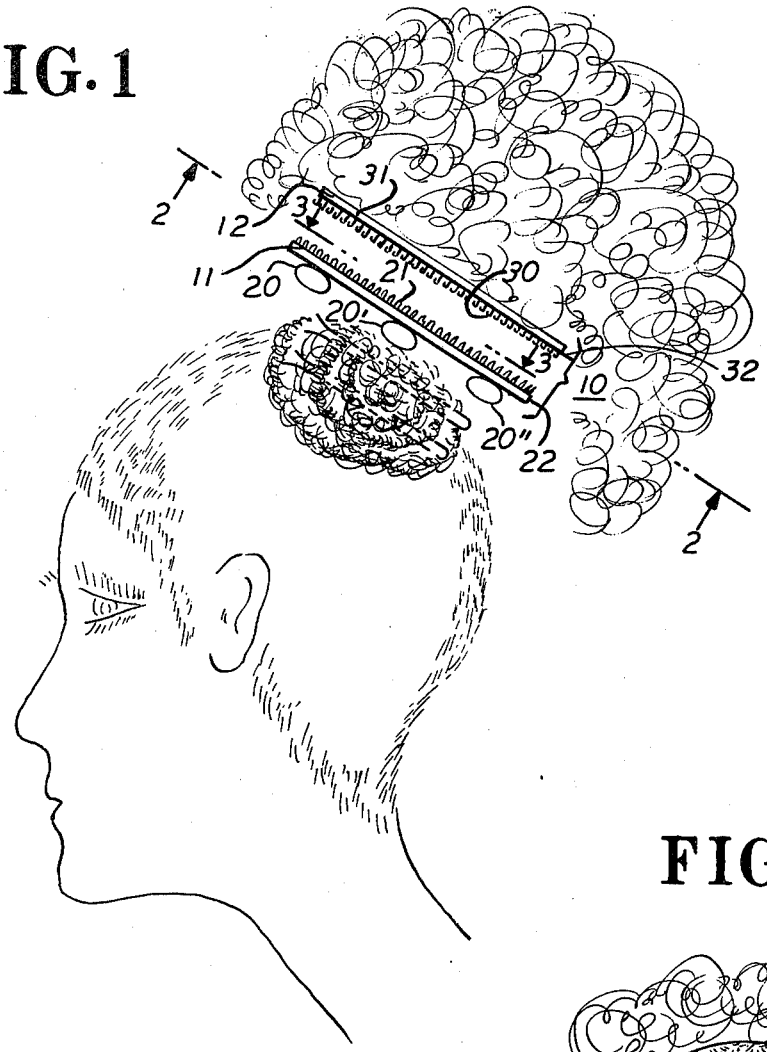
FIG. 1 is a side elevational exploded view of the hairpiece apparatus in accordance with the invention.
Figure 2:
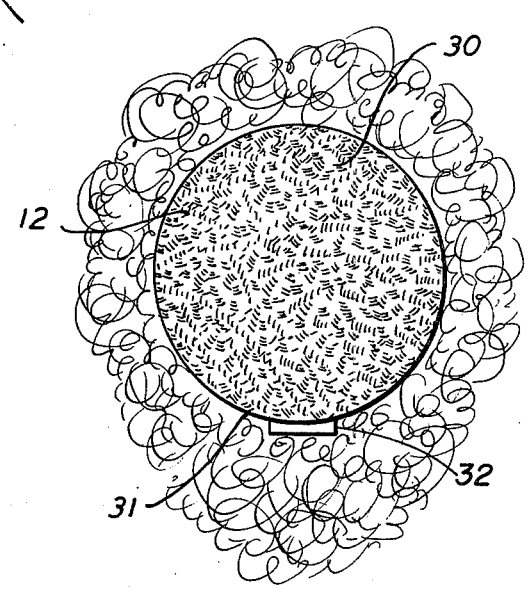
FIG. 2 is a bottom plan view of the pad which includes hair or hair-like fibers mounted thereon, taken at line 2—2 of FIG. 1.
Figure 3:
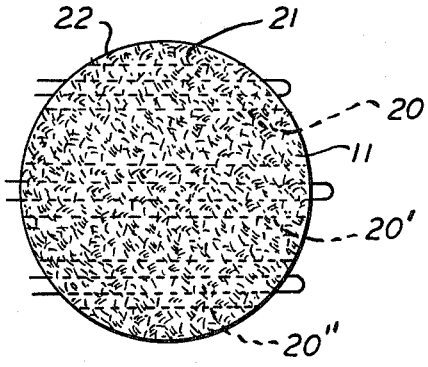
FIG. 3 is a top plan view of the pad which may be positioned in and secured to the wearer's hair, taken at line 3—3 of FIG. 1.

In the preferred embodiment of the invention as shown in the Figures, the hairpiece apparatus 10, for example, includes a pad 11 which may be positioned in and secured to the wearer's hair, and another pad 12 which may be detachably secured to the pad 11. The pad 11, as shown in FIGS. 1 and 3, includes a plurality of depending members 20, 20', 20'' which are generally hollow and tubular and which are comprised of compressible material, which receive pad-securing means such as hairpins inserted therein to securely position the pad in the wearer's hair. The pad 11 further includes a binding agent 21 which covers the interface surface thereof. The pad 12, as shown in FIGS. 1 and 2, includes hair or hair-like fibers mounted thereon which may be formed into a hairstyle, a binding agent 30 which covers the interface surface thereof and which enables the pad 12 to be detachably secured to the pad 11 without disrupting the hairstyle, and an extending portion 32 which may be gripped and pulled to enable convenient separation of the pads 11 and 12. The binding agents 21 and 30 may comprise, for example, a multiplicity of interengageable elements which extend from the interface surfaces 22, 31 respectively of the pads 11 and 12, such as loop elements on the pad 11 and hook elements on the pad 12.

In order to form a hairstyle on the pad 12, a hairdresser may mount the pad 12 on a head form which includes a covering of binding agent thereon by interconnecting the binding agent 30 of the pad 12 with the binding agent on the head form. Upon styling of the hair or hair-like fibers thereof, the pad 12 may be detached from the hairdresser's head form and interconnected to a portable head form similarly covered with binding agent thereon, on which the hairpiece may be transported or stored until the wearer is ready to position same in the hair. The users of such head forms are thereby able to secure the pad 12 thereto without the use of pins or the like which are difficult to work with.

To position the hairpiece in the wearer's hair, a pin curl may be formed as shown in FIG. 1 and secured by hairpins or the like. The pad 11 may then be secured to the pin curl by inserting a small number of hairpins or the like into the depending members 20, 20′, 20″, so that the hairpins grip the depending members and the pin curl. The small number of pins used to secure the pad 11 are comfortable and convenient to use, and are easily located without causing disruption of the hairstyle. The hairpins extend beneath the interface surface 22 of the pad 11 which includes the binding agent 21 thereon, which prevents interference with the binding agent 21 which would otherwise result from covering portions thereof. This procedure enables the pad 11 to be secured in the wearer's hair before attaching thereto the pad 12 with the hairstyle formed thereon, which further prevents disruption of the hairstyle. The pad 12, which may comprise a previously-owned hairpiece pad which may be accommodated for use in conjunction with a pad 11 by applying a covering of binding agent to the interface surface thereof, may then be detachably secured to the pad 11 by interconnecting the binding agents 21 and 30 to provide a strong interconnection which is not subject to shifting and which will prevent disruption of the hairstyle.

To remove the hairpiece apparatus 10, the extending portion 32 of the pad 12 may be gripped and pulled to conveniently separate the binding agents 21 and 30 and to detach the pad 12 from the pad 11 without disrupting the hairstyle. The pad 11 may then be removed by withdrawing the small number of hairpins from the depending members 20, 20′, 20″. The small number of hairpins may be readily located and conveniently removed without disrupting the hairstyle.

While the present invention has been particularly set forth in terms of specific embodiments thereof, it will be understood, in view of the instant disclosure, that variations may be made by those skilled in the art within the scope of the invention and disclosure. The invention is thus to be broadly construed within the scope and spirit of the appended claims.

I claim:

1. A hairpiece, comprising:

a. a first pad, one surface of which is securable to the hair of the user, which one surface includes a compressible member extending therefrom through which means are insertable which are also extendable into the wearer's hair for engagement therewith, including a first binding agent substantially covering the other surface thereof; and b. a second pad, including hair or hair-like fibers secured to one surface thereof and a second binding agent substantially covering the other surface thereof, which second binding agent is interengageable with the first binding agent so as to enable detachable connection of the second pad to the first pad.

* * * * *